US007311350B2

(12) United States Patent
Mitsui et al.

(10) Patent No.: US 7,311,350 B2
(45) Date of Patent: Dec. 25, 2007

(54) DOOR DEVICE

(75) Inventors: Jiro Mitsui, Yamanashi (JP); Hiroki Hattori, Yamanashi (JP)

(73) Assignee: Mitsui Mining & Smelting Co., Ltd., Tokyo (JP)

( * ) Notice: Subject to any disclaimer, the term of this patent is extended or adjusted under 35 U.S.C. 154(b) by 35 days.

(21) Appl. No.: 11/121,925

(22) Filed: May 5, 2005

(65) Prior Publication Data

US 2005/0264031 A1 Dec. 1, 2005

(30) Foreign Application Priority Data

May 26, 2004 (JP) ..... 2004-156515

(51) Int. Cl.
*E05B 65/20* (2006.01)

(52) U.S. Cl. ..... 296/146.9; 296/146.1; 296/187.12; 292/216

(58) Field of Classification Search ..... 296/187.12, 296/146.9, 146.6, 146.1; 292/216, 201, DIG. 65, 292/DIG. 23; 49/503
See application file for complete search history.

(56) References Cited

U.S. PATENT DOCUMENTS 3,331,624 A * 7/1967 Pugh ..... 292/216
3,350,128 A * 10/1967 Martens ..... 292/341.12
3,799,596 A * 3/1974 Nozomu et al. ..... 292/216
3,819,228 A * 6/1974 Cornacchia ..... 296/146.9
4,382,622 A * 5/1983 Ishikawa ..... 292/216
4,544,198 A * 10/1985 Ochiai et al. ..... 296/155
6,113,161 A * 9/2000 Jung et al. ..... 292/216
6,616,214 B2 * 9/2003 Wattebled ..... 296/146.1
6,695,362 B2 * 2/2004 Kluting et al. ..... 292/216
6,848,737 B2 * 2/2005 Mikolai et al. ..... 296/146.9
6,955,389 B2 * 10/2005 Suzuki et al. ..... 296/146.4
6,966,600 B2 * 11/2005 Moriyama ..... 296/146.1
7,000,976 B2 * 2/2006 Azzouz et al. ..... 296/146.1
7,059,654 B2 * 6/2006 Ichinose ..... 296/146.1
2001/0022456 A1 * 9/2001 Kitagawa ..... 296/188
2005/0140146 A1 * 6/2005 Spurr ..... 292/216

FOREIGN PATENT DOCUMENTS

JP 2004-27726 A 1/2004

* cited by examiner

*Primary Examiner*—Dennis H. Pedder
*Assistant Examiner*—Mike Hernandez
(74) *Attorney, Agent, or Firm*—Sughrue Mion Pllc.

(57) ABSTRACT

A door device has a plurality of doors that open or close a single opening in a vehicle. The doors have mutually opposing opening ends. A door interlock mechanism interlocks the opening ends of the doors when the doors receive an impact from the exterior of the vehicle while both the doors are in closed states.

7 Claims, 5 Drawing Sheets

DOOR DEVICE

BACKGROUND OF THE INVENTION

1) Field of the Invention

The present invention relates to a door device and particularly relates to a door device that has two doors to close a single opening in a vehicle body.

2) Description of the Related Art

Some of the vehicles are provided with a door device that has a hinged front door and a slidable rear door and there is no center pillar between the two doors. In other words, these door devices have a so-called center-pillarless-structure. The center pillar becomes an obstruction when entering the vehicle; however, it gives sturdiness to the vehicle and protects the people inside the vehicle in case of a side collision. Since these vehicles do not have the center pillar they need some protective measures in case of a side collision.

As a safety measure against side collisions, such door devices have an interlock mechanism. This interlock mechanism locks the doors to each other when both the doors in closed states. This interlock mechanism includes a striker in one of doors, and a latch unit, which engages with the striker, in the other door. The latch unit includes a close actuator, which interlocks the doors when they are in the closed states. The latch unit further includes a release actuator, which releases the lock of the doors when the doors are opened. Such a door device has been disclosed in Japanese Published Unexamined Patent Application No. 2004-27726.

However, according to the conventional door device, the doors are locked when they are in the closed states; in other words, it need to be first detected whether the doors are in the closed states before actuating the close actuator. Erroneous operation prevention control, premised on the erroneous detection of the closed states despite the doors being in opened states, is thus required. Also, when the rear door is made to open and close automatically, the actuation of the respective actuators of the interlock mechanism must be controlled in accordance with the automatic opening and closing of the rear door. Complex operations, which are in accordance with the opening and closing of the doors, are thus required with the conventional door device.

Moreover, since the interlock mechanism is actuated by means of actuators, when a malfunction of the electrical system, such as an actuator malfunction or malfunction of a detection unit for detecting the closed state of the respective doors, occurs, the action of the interlock mechanism becomes disabled or the doors become unable to be opened in a normal door opening operation. In addition, since the two actuators of the close actuator and the release actuator are used, the cost is high.

SUMMARY OF THE INVENTION

It is an object of the present invention to at least solve the problems in the conventional technology.

According to an aspect of the present invention, a door device has a plurality of doors that open or close a single opening in a vehicle. The doors have mutually opposing opening ends. A door interlock mechanism interlocks the opening ends of the doors when the doors receive an impact from the exterior of the vehicle while both the doors are in closed states.

The other objects, features, and advantages of the present invention are specifically set forth in or will become apparent from the following detailed description of the invention when read in conjunction with the accompanying drawings.

DETAILED DESCRIPTION

Exemplary embodiments of a door device according to the present invention shall now be explained in detail with reference to the attached drawings. This invention is not restricted to these embodiments.

Figure 1:
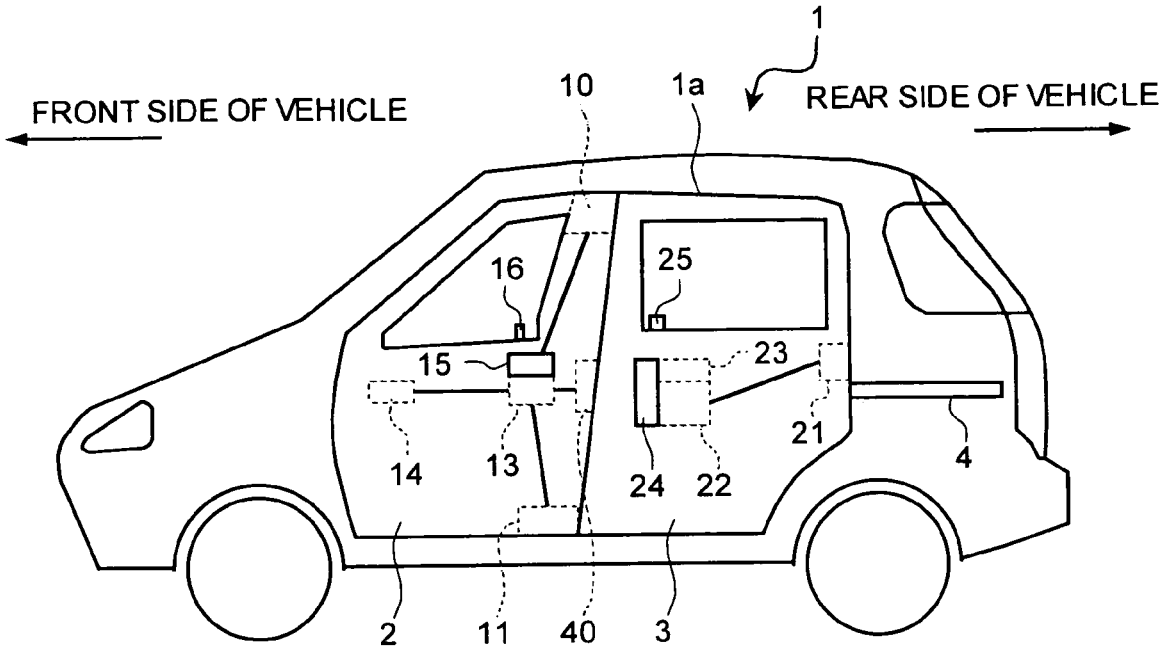
FIG. 1 is a schematic side view of a vehicle to which the door device according to an embodiment of the present invention is applied.
Figure 2:
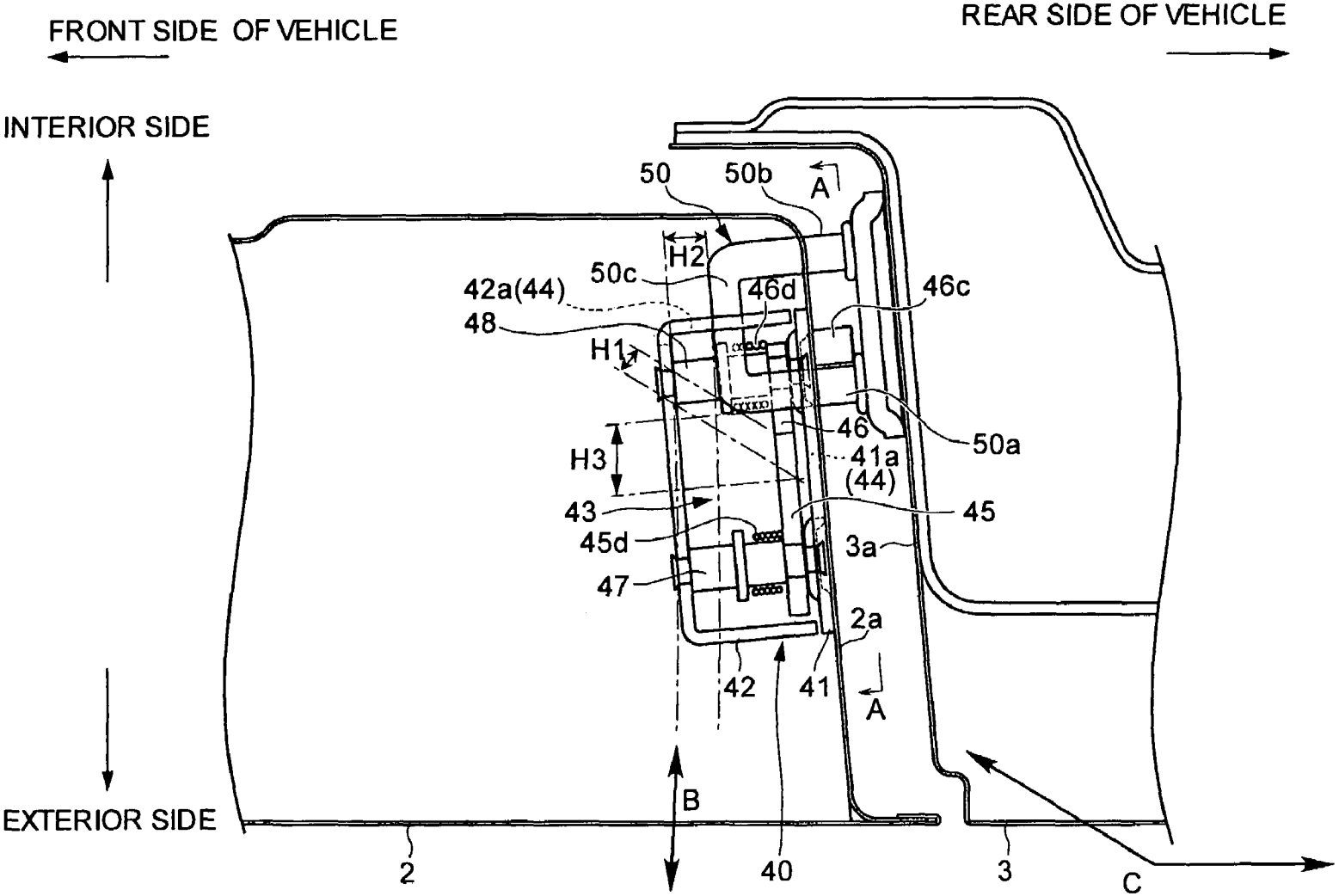
FIG. 2 is a sectional plan view of a door interlock mechanism of the door device shown in FIG. 1.
Figure 3:
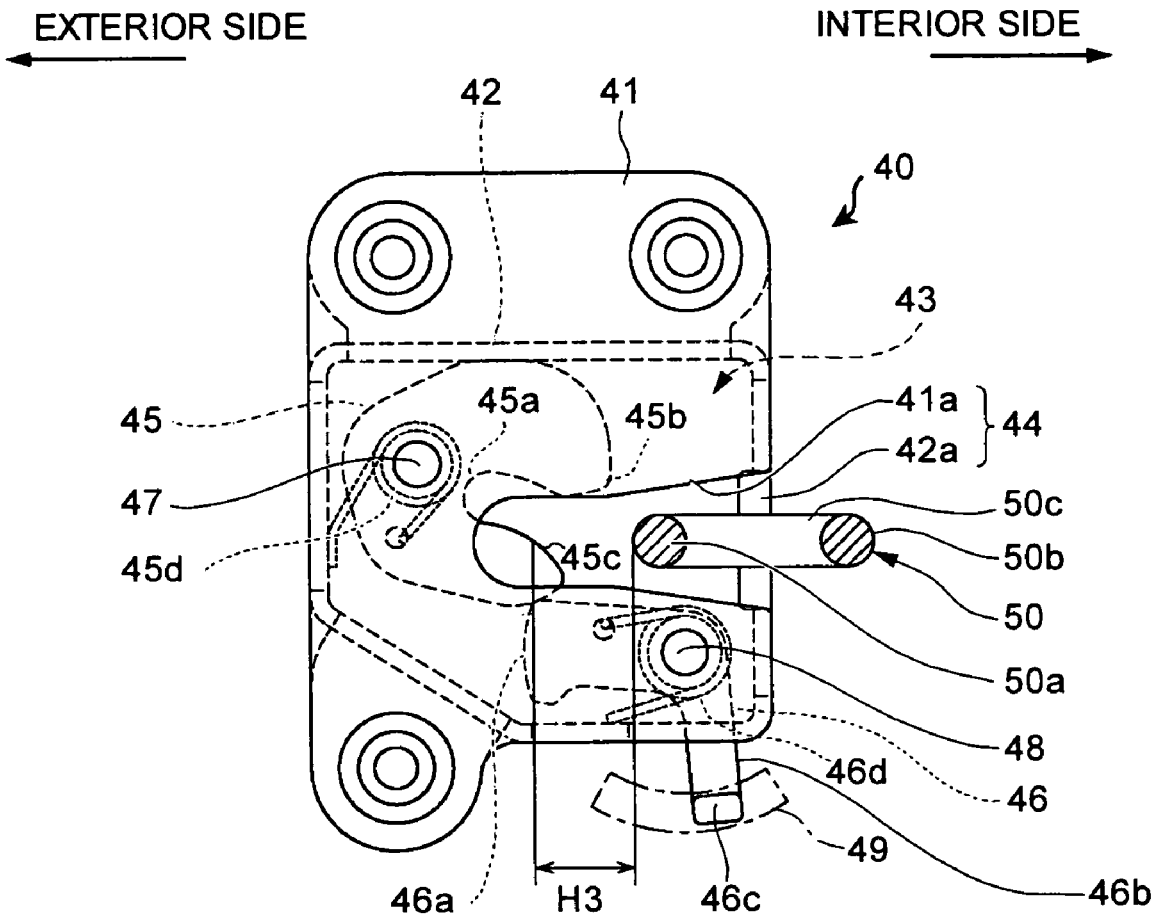
FIG. 3 is an external rear view of the door interlock mechanism along arrows A-A shown in FIG. 2.

FIG. 1 is a schematic side view of a vehicle to which a door device according to an embodiment of the present invention is applied, FIG. 2 is a sectional plan view of a door interlock mechanism of the door device, and FIG. 3 is an external rear view (taken on arrows A-A of FIG. 2) of the door interlock mechanism shown in FIG. 2.

As shown in FIG. 1, the door device is applied to the so-called center pillarless vehicle 1. The vehicle 1 has a single opening 1*a* and the door device closes this opening 1*a*. The door device has two doors 2 and 3. The opening 1*a* in the present embodiment is formed to be continuous in the lengthwise direction at a side of the vehicle 1. The door 2 is is a front door that is rotatably supported at the front side of the opening 1*a* by means of a front hinge. The door 3 is is a rear door that is supported in a manner enabling sliding along the lengthwise direction of the vehicle 1. The opening 1*a* can be closed by the front door 2 and the rear door 3. The doors 2 and 3 may instead be biparting doors that are both rotatably supported at the front side of the opening by means of hinges.

An upper latch mechanism 10 is located at an upper rear portion and a lower latch mechanism 11 is located at a lower rear portion of the front door 2. These are known latch mechanisms that close the front door 2 by engaging with strikers (not shown) mounted on a main vehicle body.

The upper latch mechanism 10 and the lower latch mechanism 11 have a release function, which keeps the front door 2 closed when the front door 2 is subject to a door closing operation and yet enables the opening of the front door 2 by releasing the closed state of the front door 2 in accordance with the operation of a front remote controller 13.

An inside handle 14 is located at the interior side of the front door 2 and an outer handle 15 is located at the exterior side. The inside handle 14 and the outer handle 15 are connected to the front remote controller 13. When the inside handle 14 or the outer handle 15 is operated, the front remote controller 13 operates the upper latch mechanism 10 and the lower latch mechanism 11 to release the closed state of the front door 2.

A lock/unlock knob 16, which is connected to the front remote controller 13, is positioned at the interior side of the front door 2. When the lock/unlock knob 16 is in the locked state, the front remote controller 13 makes ineffective the operations from the inside handle 14 and the outer handle 15 and the upper latch mechanism 10 and the lower latch mechanism 11 keep the front door 2 in the closed state even when the inside handle 14 or the outer handle 15 is operated. On the other hand, when the lock/unlock knob 16 is in the unlocked state, the front remote controller 13 operates the upper latch mechanism 10 and the lower latch mechanism 11 in accordance with an operation of the inside handle 14 or the outer handle 15 and releases the closed state of the front door 2.

Rollers (not shown), which support the rear door 3, are positioned at an upper front portion, a lower front portion, and a central rear portion of the rear door 3. The rollers (not shown) roll along rail units 4, which are mounted on an upper portion, a lower portion, and a central rear portion of the opening formed in the main vehicle body, and the rear door 3 is thereby enabled to be opened and closed along the lengthwise direction of the vehicle.

A rear latch mechanism 21 is located at substantially the center of a rear portion of the rear door 3. The rear latch mechanism 21 is a known latch mechanism and closes the rear door 3 by engaging with a striker (not shown) mounted to the main vehicle body.

The rear latch mechanism 21 has a release function, which keeps the rear door 3 closed when the rear door is subject to a door closing operation and yet enables the opening of the rear door 3 by releasing the closed state of the rear door 3 in accordance with the operation of a rear remote controller 22.

An inside handle 23 is located at the interior side of the rear door 3 and an outer handle 24 is located at the exterior side. The inside handle 23 and the outer handle 24 are connected to the rear remote controller 22. When the inside handle 23 or the outer handle 24 is operated, the rear remote controller 22 operates the rear latch mechanism 21 to release the closed state of the rear door 3.

A lock/unlock knob 25, which is connected to the rear remote controller 22, is positioned at the interior side of the rear door 3. When the lock/unlock knob 25 is in the locked state, the rear remote controller 22 makes ineffective the operations from the inside handle 23 and the outer handle 24 and the rear latch mechanism 21 keeps the rear door 3 in the closed state even when the inside handle 23 or the outer handle 24 is operated. On the other hand, when the lock/unlock knob 25 is in the unlocked state, the rear remote controller 22 operates the rear latch mechanism 21 in accordance with an operation of the inside handle 23 or the outer handle 24 and releases the closed state of the rear door 3.

As shown in FIG. 2, the front door 2 has a rear end face 2*a* that is formed to incline slightly towards the front of the vehicle from the exterior side to the interior side. The rear end face 2*a* of the front door 2 forms the opening end of the front door 2. In opening or closing the front door 2, the opening end moves in the exterior or interior direction as shown by the arrows B in FIG. 2. The rear door 3 has a front end face 3*a* that is formed substantially parallel to the rear end face 2*a* of the front door 2 from the exterior side to the interior side. The front end face 3*a* of the rear door 3 forms the opening end of the rear door 3. In opening or closing the rear door 3, the opening end moves mainly in the rear or front direction of the vehicle 1 and incliningly towards the interior side near the closed position as shown by an arrow C in FIG. 2. When the front door 2 and the rear door 3 are closed, the rear end face 2*a* of the front door 2 and the front end face 3*a* of the rear door 3 oppose each other.

A latch unit 40 is provided at the rear end face 2*a* of the front door 2. Moreover, a striker 50 is provided at the front end face 3*a* of the rear door 3. The latch unit 40 and the striker 50 form the door interlock mechanism that interlocks the front door 2 and the rear door 3. Although the door interlock mechanism is shown on the left side, i.e., passenger side, the door interlock mechanism can be provided on the right side, i.e., driver side.

As shown in FIG. 2 and FIG. 3, the latch unit 40 has a cover plate 41 and a housing 42. The cover plate 41 has the form of a plate and forms a vehicle rear side casing of the latch unit 40. The housing 42 box-shaped and covers the front vehicle side of the cover plate 41 and forms a vehicle front side casing of the latch unit 40. A container 43, which contains the latch unit 40 in the interior, is thus formed by the cover plate 41 and the housing 42. The container 43 has a notch groove 44, which extends substantially horizontally from the interior side to the exterior side, at a position that is substantially at the center in the height direction. The notch groove 44 is formed as a notch 41*a*, which extends from the interior side to the exterior side, at the cover plate 41, and as a notch 42*a* at the interior side of the housing 42. This notch groove 44 is an entry groove into which the striker 50 enters.

The latch unit 40 has a latch 45 and a ratchet 46 disposed in the interior of the container that is formed by the cover plate 41 and the housing 42.

The latch 45 is disposed rotatably via a latch shaft 47, which extends substantially horizontally along the lengthwise direction of the vehicle 1, at a position above the notch groove 44 of the container 43, and has an engaging groove 45*a*, a hooking portion 45*b*, and a latching portion 45*c*. The engaging groove 45*a* is formed towards the latch shaft 47 from the outer peripheral surface of the latch 45 and has a width enabling the striker 50 to be contained therein. The hooking portion 45*b* is positioned on the interior side of the engaging groove 45*a* when the engaging groove 45*a* is opened towards the lower direction. This hooking portion 45*b* opens the notch groove 44 and then stops when the latch 45 is rotated counterclockwise (see FIG. 3), and extends inside the notch groove 44 of the container 43 when the latch 45 is rotated clockwise (see FIG. 5 and FIG. 7). The latching portion 45*c* is positioned on the exterior side of the engaging groove 45*a* when the engaging groove 45*a* is opened towards the lower direction. When the latch 45 is rotated counterclockwise, the latching portion 45*c* crosses the notch groove 44 of the container 43 and stops in a state of gradually inclining upwards towards the inner side (interior side) of the notch groove 44 (see FIG. 3). Moreover, between the latch 45 and the container 43 is disposed a latch spring 45*d*, which elastically urges the latch 45 in the counterclockwise direction constantly. In the normal state in which the latch 45 is not involved with the striker 50, the latch 45 of the present arrangement has the hooking portion 45*b* side put in contact with the inner wall of the housing 42 and is stopped in rotation while being urged by the latch spring 45*d* as shown in FIG. 3. In this normal state, the latching portion 45*c* crosses the notch groove 44 and is gradually inclined upwards towards the inner side (interior side) of the notch groove 44.

The ratchet 46 is rotatable with respect to a ratchet shaft 48. The ratchet shaft 48 extends substantially horizontally along the lengthwise direction of the vehicle 1, at a position below the notch groove 44 of the container 43, and has an engaging portion 46*a* and an acting portion 46*b*. The engaging portion 46*a* extends radially outwards from the ratchet shaft 48 to the exterior side and, when the ratchet 46 rotates clockwise, can engage via its protruding end face with the hooking portion 45*b* and the latching portion 45*c* of the latch 45. The acting portion 46*b* extends radially outward from the ratchet shaft 48 towards the lower side. The acting portion 46*b* extends to the exterior of the container 43 and its extension end has a curved release operation portion 46*c*. The release operation portion 46*c* protrudes outside the rear end face 2*a* of the front door 2 from an operation hole 49, provided in the rear end face 2*a*. The operation hole 49 is formed to be an arc centered about the ratchet shaft 48 and thus allows the movement of the release operation portion 46*c* when the ratchet 46 rotates about the ratchet shaft 48. Also, a ratchet spring 46*d*, which elastically urges the ratchet 46 in the clockwise direction constantly, is disposed between the ratchet 46 and the container 43. In the normal state in which the latch 45 is not involved with the striker 50, the ratchet 46 of the present arrangement is stopped in rotation by the engaging portion 46*a* being put in contact with the latching portion 45*c* of the latch 45 while being urged by the ratchet spring 46*d* as shown in FIG. 3.

As shown in FIG. 2 and FIG. 3, the striker 50 is substantially U-shaped with two rod portions 50*a* and 50*b*, extending in parallel, and a connecting portion 50*c*, connecting the ends at one side of the respective rod portions 50*a* and 50*b*. The striker 50 has the ends at the other side of the respective rod portions 50*a* and 50*b* fixed to the front end face 3*a* of the rear door 3 with the respective rod portions 50*a* and 50*b* positioned substantially horizontally, the rod portion 50*a* positioned towards the interior side, the rod portion 50*b* positioned towards the exterior side, and the connecting portion 50*c* positioned towards the front of the vehicle 1. The striker 50 is thus disposed so as to enable insertion and extraction of the respective rod portions 50*a* and 50*b* and the connecting portion 50*c* in and out of the notch groove 44 of the container 43 at the latch unit 40.

Figure 4:
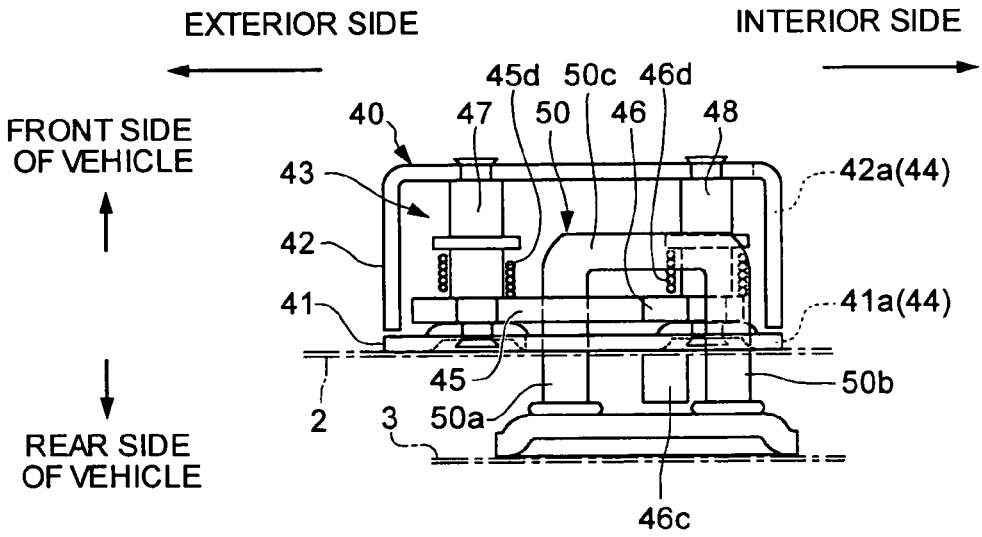
FIG. 4 is a sectional plan view for explaining an operation of the door interlock mechanism.
Figure 5:
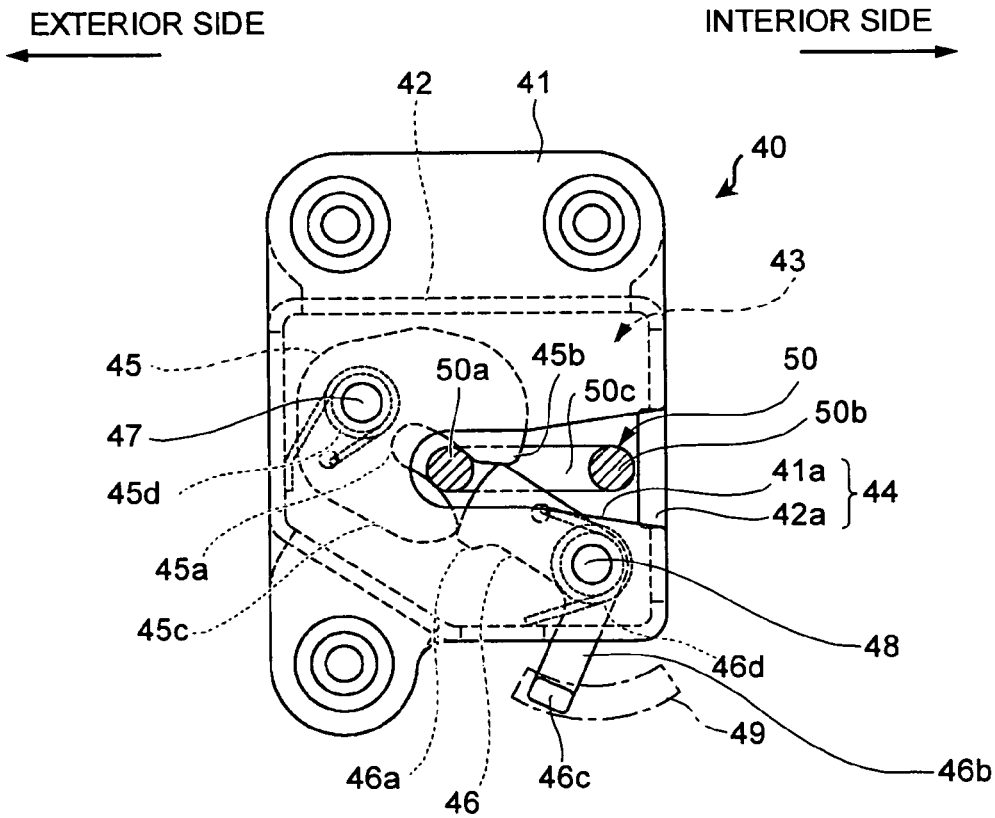
FIG. 5 is an external rear view of the door interlock mechanism of FIG. 4.
Figure 6:
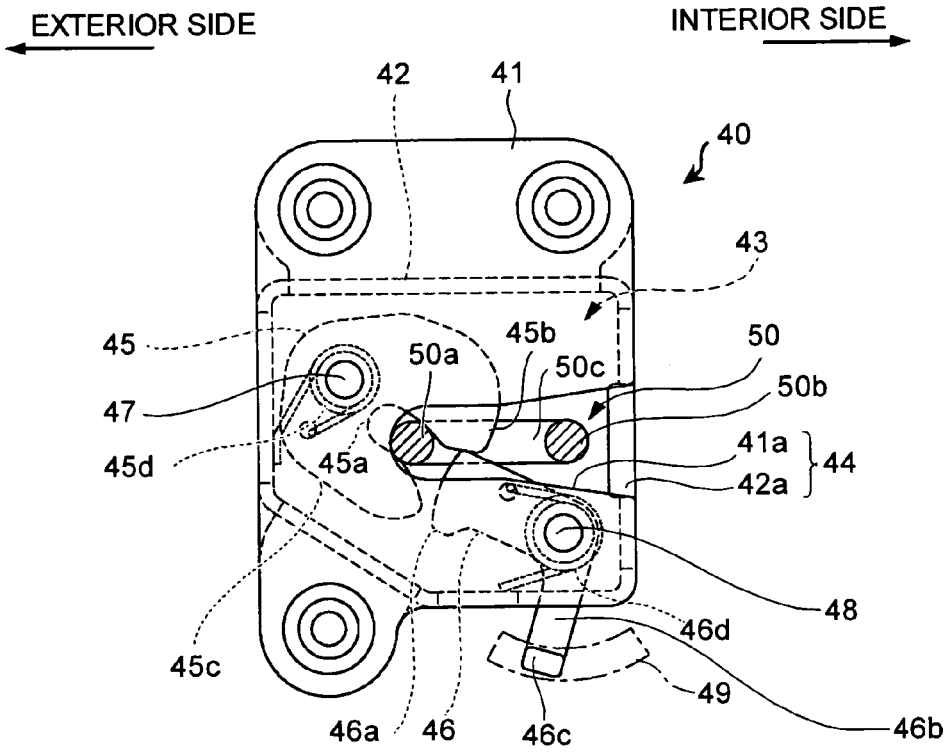
FIG. 6 is an external rear view for explaining still another operation of the door interlock mechanism shown in FIG. 5.

The operations of the door interlock mechanism shall now be explained. FIG. 4 is a sectional plan view for explaining an operation of the door interlock mechanism by this invention, FIG. 5 is an external rear view of the door interlock mechanism of FIG. 4, and FIG. 6 is an external rear view for explaining a further operation of the door interlock mechanism shown in FIG. 5.

In regard to the opening and closing of the doors 2 and 3, in closing the rear door 3 while the front door 2 is in the closed state, the striker 50 enters into the notch groove 44 from the vehicle rear side towards the vehicle front side and incliningly from the exterior side to the interior side as shown in FIG. 2. Moreover, in opening the rear door 3 while the front door 2 is in the closed state, the striker 50 separates from the notch groove 44 from the vehicle front side towards the vehicle rear side and incliningly from the interior side to the exterior side. With regard to the directions of opening and closing the rear door 3, a gap H1 is provided to prevent the mutual contact of the striker 50 and the latching portion 45*c* of the latch 45 of the latch unit 40 in the interior/exterior directions in the normal state.

Meanwhile, in closing the front door 2 while the rear door 3 is in the closed state, the striker 50 enters into the notch groove 44 from the interior side to the exterior side. Moreover, in opening the front door 2 while the rear door 3 is in the closed state, the striker 50 separates from the notch groove 44 from the exterior side to the interior side. With regard to the directions of opening and closing the front door 2, a gap H2 is provided to prevent the mutual contact of the striker 50 and the peripheral edge of the notch 42*a* of the housing 42 of the latch unit 40 in the lengthwise direction of the vehicle.

Thus, due to presence of the gaps H1 and H2, the striker 50 and the latch unit 40 do not contact each other when the doors 2 and 3 are opened and closed. Moreover, when the front door 2 and the rear door 3 are in the closed state, the striker 50 and the latch unit 40 are in a disengaged state since there is a gap H3 between the striker 50 and the latching portion 45*c* of the latch 45 of the latch unit 40.

If, when the doors 2 and 3 are in the normal closed state, the doors 2 and 3 receive an impact from the exterior (exterior side) of the vehicle 1, the front door 2, which is a hinged door, will be pushed in towards the interior side. That is, the latch unit 40 that is disposed in the front door 2 moves towards the interior side and the latch unit 40 and the striker 50 approach each other relatively as shown in FIG. 4 and FIG. 5. The rod portion 50*a* of the striker 50 thus enters into the inner side (interior side) of the notch groove 44 of the latch unit 40. The rod portion 50*a* of the striker 50, which has entered into the inner side of the notch groove 44, enters into the engaging groove 45*a* while contacting the latching portion 45*c* of the latch 45. Consequently, the latch 45 rotates in the clockwise direction of FIG. 5 against the elastic force of the latch spring 45*d*.

In this process, the elastic force of the ratchet spring 46*d* causes the protruding end face of the engaging portion 46*a* to slide against the outer peripheral shape of the latch 45, and the ratchet 46 thus rotates about the shaft center of the ratchet shaft 48 in accordance with the outer peripheral shape of the latch 45. Then, when the latching portion 45*c* of the latch 45, which rotates clockwise, moves beyond the protruding end face of the engaging portion 46*a* of the ratchet 46 due to the entry of the rod portion 50*a* of the striker 50 into the engaging groove 45*a* of the latch 45, the ratchet 46 is rotated clockwise by the elastic force of the ratchet spring 46*d* as shown in FIG. 5 and the protruding end face of the engaging portion 46*a* contacts the hooking portion 45*b* of the latch 45 and contacts the latching portion 45*c* as well.

At this point, since the latching portion 45*c* contacts the engaging portion 46*a* of the ratchet 46, the latch 45 will not rotate counterclockwise even if the elastic force of the latch spring 45*d* is applied. Moreover, since the engaging portion 46*a* contacts the hooking portion 45*b* of the latch 45, the ratchet 46 will not rotate clockwise even if the elastic force of the ratchet spring 46*d* is applied. The latch 45 and the ratchet 46 thus prevent each other's rotation against the elastic forces of the latch spring 45*d* and the ratchet spring 46*d*. Consequently, by the engaging portion 46*a* of the ratchet 46 closing the open portion of the engaging groove 45*a* of the latch 45, into which the rod portion 50*a* of the striker 50 has entered, the rod portion 50*a* of the striker 50 is confined inside the engaging groove 45*a*, thereby interlocking the doors 2 and 3 (engaged state).

If, in this engaged state, an external force acts in a direction of separating the doors 2 and 3 (mainly the rear door 3) in the vehicle lengthwise direction, since the hooking portion 45*b* of the latch 45 of the latch unit 40, the engaging portion 46*a* of the ratchet 46, and the connecting portion 50*c* of the striker 50 are overlapped, the overlapping portion prevents the movement of the connecting portion 50*c*, by which the connecting portion 50*c* of the striker 50 tends to separate from the latch 45 and the ratchet 46. By the overlapping portion thus receiving the external force, the separation of the doors 2 and 3 in the vehicle lengthwise direction is prevented.

Also, if, in the engaged state, an external force acts in a direction of separating the doors 2 and 3 (mainly the front door 2) in the interior and exterior directions, since the engaging portion 46*a* of the ratchet 46 closes off the engaging groove 45*a* of the latch 45 of the latch unit 40, the movement of the rod portion 50*a*, by which the rod portion 50*a* of the striker 50 tends to separate from the engaging groove 45*a*, is prevented. Since the ratchet shaft 48 mainly receives, via the engaging portion 46*a*, the force of movement of the rod portion 50*a*, rigidity is provided. Since the ratchet 46 (ratchet shaft 48) thus receives the external force, the separation of the doors 2 and 3 in the interior and exterior directions is prevented.

When the striker 50 moves further towards the exterior side from the state shown in FIG. 5, the rod portion 50*a* reaches the inner side of the notch groove 44 as shown in FIG. 6. In this case, by the latch 45 rotating clockwise further against the elastic force of the latch spring 45*d*, the ratchet 46 is pushed by the hooking portion 45*b* of the latch 45 and rotates counterclockwise against the elastic force of the ratchet spring 46*d* (another engaged state).

If in this another engaged state, an external force acts in the direction of separating the doors 2 and 3 (mainly the rear door 3) in the vehicle lengthwise direction, since the hooking portion 45*b* of the latch 45 of the latch unit 40, the engaging portion 46*a* of the ratchet 46, and the connecting portion 50*c* of the striker 50 are overlapped, the overlapping portion prevents the movement of the connecting portion 50*c*, by which the connecting portion 50*c* of the striker 50 tends to separate from the latch 45 and the ratchet 46. By the overlapping portion thus receiving the external force, the separation of the doors 2 and 3 in the vehicle lengthwise direction is prevented.

Also, if, in the another engaged state, an external force acts in a direction of separating the doors 2 and 3 (mainly the front door 2) in the interior and exterior directions, since the engaged state shown in FIG. 5 is attained, the ratchet 46 (ratchet shaft 48) likewise receives the external force and thereby prevents the separation of the doors 2 and 3 in the interior and exterior directions.

When the front door 2 or the rear door 3 is in the opened state, the latch unit 40 is in the state shown in FIG. 3. That is, when the front door 2 or the rear door 3 is in the opened state, since the rear end face 2*a* of the front door 2 is exposed, the latching portion 45*c* of the latch 45 is positioned so as to be exposed from the notch groove 44. If at this point, the latching portion 45*c* is pushed to the exterior side, an abnormal engaged state is entered wherein the latch 45 and the ratchet 46 are engaged without the striker 50 entering into the engaging groove 45*a* of the latch 45. In this abnormal engaged state, though the doors 2 and 3 can be put in the closed states, the door interlock mechanism will not operate when an impact is applied to the doors 2 and 3 from the exterior of the vehicle 1. When the abnormal engaged state is entered, the abnormal engaged state can be exited by moving the release operation portion 46*c* of the ratchet 48 that protrudes from the operation hole 49, provided in the rear end face 2*a* of the front door 2, in the counterclockwise direction shown in FIG. 5 for example and thereby disengaging the engagement of the latching portion 45*c* of the latch 45 with the engaging portion 46*a* of the ratchet 46.

Figure 7:
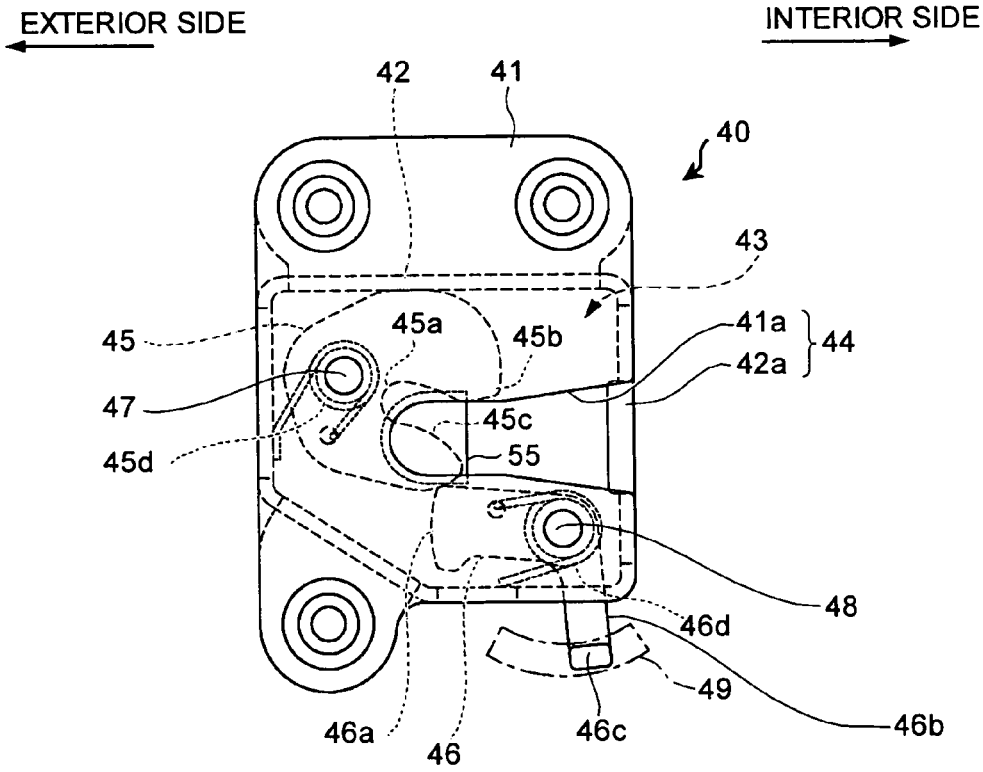
FIG. 7 is an external rear view of latch part with a cover member.

The abnormal engaged state is entered since the latching portion 45*c* of the latch 45 of the latch unit 40 is exposed from the notch groove 44 when the front door 2 or the rear door 3 is in the opened state. A cover member 55, which covers the latching portion 45*c* of the latch 45 that is exposed from the notch groove 44, is thus provided as shown in FIG. 7. The cover member 55 is, for example, disposed in a movable manner at the exterior side and is elastically urged by an not shown spring member, etc., to be in the state shown in FIG. 7. This cover member 55 is positioned so as not to be contacted by the striker 50 that enters into the notch groove 44 when the doors 2 and 3 are opened or closed. Also, when the latch unit 40 and the striker 50 are in the engaged state, the cover member 55 is pushed by the striker 50 and is moved to the interior side against the elastic force of the not shown spring member. The cover member 55 thus prevents the latch unit 40 (the latching portion 45*c* of the latch 45) from being accessed from the exterior to avoid the abnormal engaged state.

Thus, according to the door device of the present invention, the opening ends of the doors 2 and 3 are interlocked by the door interlock mechanism only when the doors 2 and 3 receive an impact from the exterior of the vehicle 1 while the doors 2 and 3 are in the closed states. Since there is thus no need to actuate the door interlock mechanism in opening or closing the doors 2 and 3, complex control is not required in relation to the normal opening and closing of the doors 2 and 3. Circumstances that disable the normal opening and closing operations of the door are also prevented. Furthermore, the door interlock mechanism does not require an actuator since an engaged state is obtained by the relative movements of the latch unit 40 and the striker 50 upon receiving an impact. Electrical control is thus made unnecessary and the arrangement is inexpensive.

Although the latch unit 40 is explained to be arranged in the front door 2 and the striker 50 is arranged in the rear door 3, the striker 50 can be arranged in the front door 2 and the latch unit 40 can be arranged in the rear door 3.

Thus, according to the present door device, the opening ends of the doors are interlocked by the door interlock mechanism only when the doors receive an impact from the exterior of the vehicle while the doors are in the closed states. As a result, there is thus no need to actuate the door interlock mechanism in opening or closing the doors, complex control is not required in relation to the normal opening and closing of the doors. Moreover, circumstances that disable the normal opening and closing operations of the door are also prevented. Furthermore, the door interlock mechanism does not require an actuator since an engaged state is obtained by the relative movements of the latch unit and the striker upon receiving an impact. Electrical control is thus made unnecessary so that and the device becomes inexpensive.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A door device comprising:

a plurality of doors that open or close a single opening in a vehicle, the doors having mutually opposing opening ends; and a door interlock mechanism that interlocks the opening ends of the doors when the doors receive an impact from the exterior of the vehicle while both the doors are in closed states wherein the door interlock mechanism comprises a striker positioned at the opening end of one said door; and a latch unit positioned at the opening end of the other said door and enabled to engage with the striker, and when the doors receive the impact, the striker and the latch unit move relative to each other from a first position in which the striker and the latch unit are not engaged to a second position in which the striker and the latch unit are engaged.

2. The door device according to claim 1, wherein the latch unit has an arrangement that releases engagement of the latch unit with the striker.

3. The door device according to claim 1, further comprising a cover member that prevents access to the latch unit from the exterior when the doors are open.

4. The door device according to claim 1, wherein said interlocking mechanism is operable upon impact to move one structure into engagement with another structure.

5. The door device according to claim 1, wherein upon impact, the striker is confined inside an engaging groove in said latch.

6. The door device according to claim 5, wherein the door interlock mechanism further comprises a rotatable ratchet that is operable in response to movement of said striker to confine said striker.

7. The door device according to claim 6, wherein the door interlock mechanism further comprises a shaft, and said ratchet is rotatable about said shaft and said shaft is structured to receive and absorb impact and prevent separation of the doors.

* * * * *